US008439477B2

(12) United States Patent
Markham et al.

(10) Patent No.: US 8,439,477 B2
(45) Date of Patent: May 14, 2013

(54) METHOD OF CHARACTERIZING ARRAY OF RESISTIVE HEATERS

(75) Inventors: Roger G. Markham, Webster, NY (US); David P. Trauernicht, Rochester, NY (US); John A. Lebens, Rush, NY (US); Christopher R. Morton, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 26 days.

(21) Appl. No.: 13/190,505

(22) Filed: Jul. 26, 2011

(65) Prior Publication Data

US 2013/0027461 A1 Jan. 31, 2013

(51) Int. Cl.
*B41J 29/393* (2006.01)

(52) U.S. Cl.
USPC ..... 347/19; 347/14; 347/57

(58) Field of Classification Search ..... 347/9, 14, 347/19, 56–59, 48, 62
See application file for complete search history.

(56) References Cited

U.S. PATENT DOCUMENTS 4,560,583 A * 12/1985 Moksvold ..... 438/11
5,504,507 A 4/1996 Watrobski et al.
6,382,756 B1 * 5/2002 Komuro ..... 347/14

FOREIGN PATENT DOCUMENTS

EP 0 641 656 9/1993

* cited by examiner

*Primary Examiner* — Juanita D Jackson
(74) *Attorney, Agent, or Firm* — Peyton C. Watkins

(57) ABSTRACT

A method of characterizing an array of resistive heaters, a first resistive heater of the array having a nominal sheet resistance, a first nominal length and a first nominal width, the method includes (a) providing a first configuration test resistor disposed proximate the first resistive heater, the first configuration test resistor including a second nominal length and a second nominal width, wherein the second nominal length is different from the first nominal length; (b) measuring a resistance of the first resistive heater; (c) measuring a resistance of the first configuration test resistor; and (d) determining the actual sheet resistance and the actual length of the first resistive heater based on the measured resistances of the first resistive heater and the first configuration test resistor.

19 Claims, 8 Drawing Sheets

METHOD OF CHARACTERIZING ARRAY OF RESISTIVE HEATERS

CROSS REFERENCE TO RELATED APPLICATIONS

Reference is made to commonly assigned and concurrently filed U.S. patent application Ser. No. 13/190,504 filed herewith by Roger Markham et al., entitled "Inkjet Printhead With Test Resistors", the disclosure of which is herein incorporated by reference.

FIELD OF THE INVENTION

The present invention relates generally to an inkjet printhead including an array of resistive heaters, and more particularly to test resistors for characterizing the manufacturing variability of the resistive heaters.

BACKGROUND OF THE INVENTION

Inkjet printing has become a pervasive printing technology. Inkjet printing systems include one or more arrays of drop ejectors provided on an inkjet printing device, in which each drop ejector is actuated at times and locations where it is required to deposit a dot of ink on the recording medium to print the image. A drop ejector includes a pressurization chamber, a drop forming mechanism (such as a resistive heater) and a nozzle. In a thermal inkjet drop ejector, ink is supplied to the pressurization chamber. A resistive heater, formed for example as a patterned thin film, is at least partially enclosed within the pressurization chamber. When one or more electrical pulses of predetermined amplitude and duration are applied to the resistive heater, ink in contact with the resistive heater is vaporized to form a bubble. The bubble grows and causes a drop of ink to be ejected through a nozzle associated with the pressurization chamber. The ink vapor bubble either is vented through the nozzle or condenses within the pressurization chamber, depending upon the design of the drop ejector. Subsequently, additional ink fills the pressurization chamber and the drop ejector is ready to eject another drop of ink. Thermal inkjet printing devices, having several hundred or more drop ejectors per printing device, also typically include driver and logic electronics to facilitate electrical interconnection to the resistive heaters.

Thermal inkjet printing devices are typically fabricated as a plurality of die on a wafer. One or more die are packaged into an inkjet printhead, and the printhead is installed in an inkjet printer that includes one or more ink supplies, a pulse source, a controller, and an advance system for advancing recording medium relative to the inkjet printhead. The reliability, energy efficiency and drop volume uniformity associated with the inkjet printhead can depend upon the manufacturing variability of the resistive heaters from die to die and from wafer to wafer. In particular, as disclosed in U.S. Pat. No. 5,504,507, in determining the appropriate voltage amplitude and/or the pulse duration for the resistive heaters on a particular inkjet printhead, it is helpful to characterize the resistance of the resistive heaters on the one or more printhead die included in the printhead. As disclosed in U.S. Pat. No. 5,504,507, since the power transformed into heat by applying a voltage V to a resistive heater having a resistance R is $V^2/R$, the higher the resistance R, the less power is available for generating heat to form the vapor bubble to eject the ink drop. As disclosed in U.S. Pat. No. 5,504,507, one or more resistive heaters on the printhead die can be tested and the test data can be encoded on the printhead die in electrically readable digital form. The data can be subsequently read in the printer and used to appropriately set the pulse amplitude and/or duration.

Typically in the printer, the voltage and/or pulse duration applied to the resistive heaters is somewhat larger than the "threshold" pulse conditions that are known to begin to eject drops of ink. For example, a pulse voltage can be set to be 10% higher than the threshold voltage. This higher voltage assures that drops are ejected even if resistances vary within the die, or if firing conditions vary (such as due to different amounts of voltage sag associated with parasitic resistances associated with firing more than one heater at a time, or firing heaters toward the center of the die as opposed to heaters nearer to the edge of the die). Although such an "overvoltage" is effective in assuring drop ejection, excessive overvoltage can result in overheating the resistive heaters, leading to premature heater burnout and lower energy efficiency. In addition, drop size uniformity from printhead to printhead can be related to the amount of energy dissipation in the resistive heaters.

Although measuring the resistance of the resistive heaters as disclosed in U.S. Pat. No. 5,504,507 provides an improved level of control of the appropriate pulsing conditions, it provides only an approximation. This is because what is more important in characterizing heating of the resistive heaters is the power density in the heater rather than the power itself. The power density in the heater is the power P dissipated in the heater divided by the area A of the heater. For a rectangular heater having a length L, a width W, a thickness t and a resistivity ρ, $R=\rho L/Wt$, and $A=LW$. Therefore the power density in the resistive heater is given by:

$$P/A=(V^2/R)/LW=V^2t/\rho L^2=V^2/\rho_s L \quad (1),$$

where $\rho_s=\rho/t$ is the sheet resistivity of the resistive heater material. Due to manufacturing variability, $\rho_s$ can vary due to both chemical composition and thickness of the deposited resistive heater material. The length L of the resistive heater can also vary, for example due to variation in the placement of the edges of metal electrodes contacting the resistive heater, due to variation in etching processes for example.

Therefore, what is needed for improved control of the appropriate level of pulse amplitude and/or duration for a particular printhead die, as well as for improved manufacturing control of printhead wafers, is improved test structures that are capable of determining the actual sheet resistivity $\rho_s$, the actual length L, and optionally the actual width W of the resistive heaters on a printhead die.

SUMMARY OF THE INVENTION

A method of characterizing an array of resistive heaters, a first resistive heater of the array having a nominal sheet resistance, a first nominal length and a first nominal width, the method comprising (a) providing a first configuration test resistor disposed proximate the first resistive heater, the first configuration test resistor including a second nominal length and a second nominal width, wherein the second nominal length is different from the first nominal length; (b) measuring a resistance of the first resistive heater; (c) measuring a resistance of the first configuration test resistor; and (d) determining the actual sheet resistance and the actual length of the first resistive heater based on the measured resistances of the first resistive heater and the first configuration test resistor.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

As used herein, a test resistor is a resistor used primarily or solely for testing purposes, such as gathering data that is relevant to geometrical characteristics or electrical resistance characteristics of resistive heaters that are associated with drop ejectors.

Figure 1:
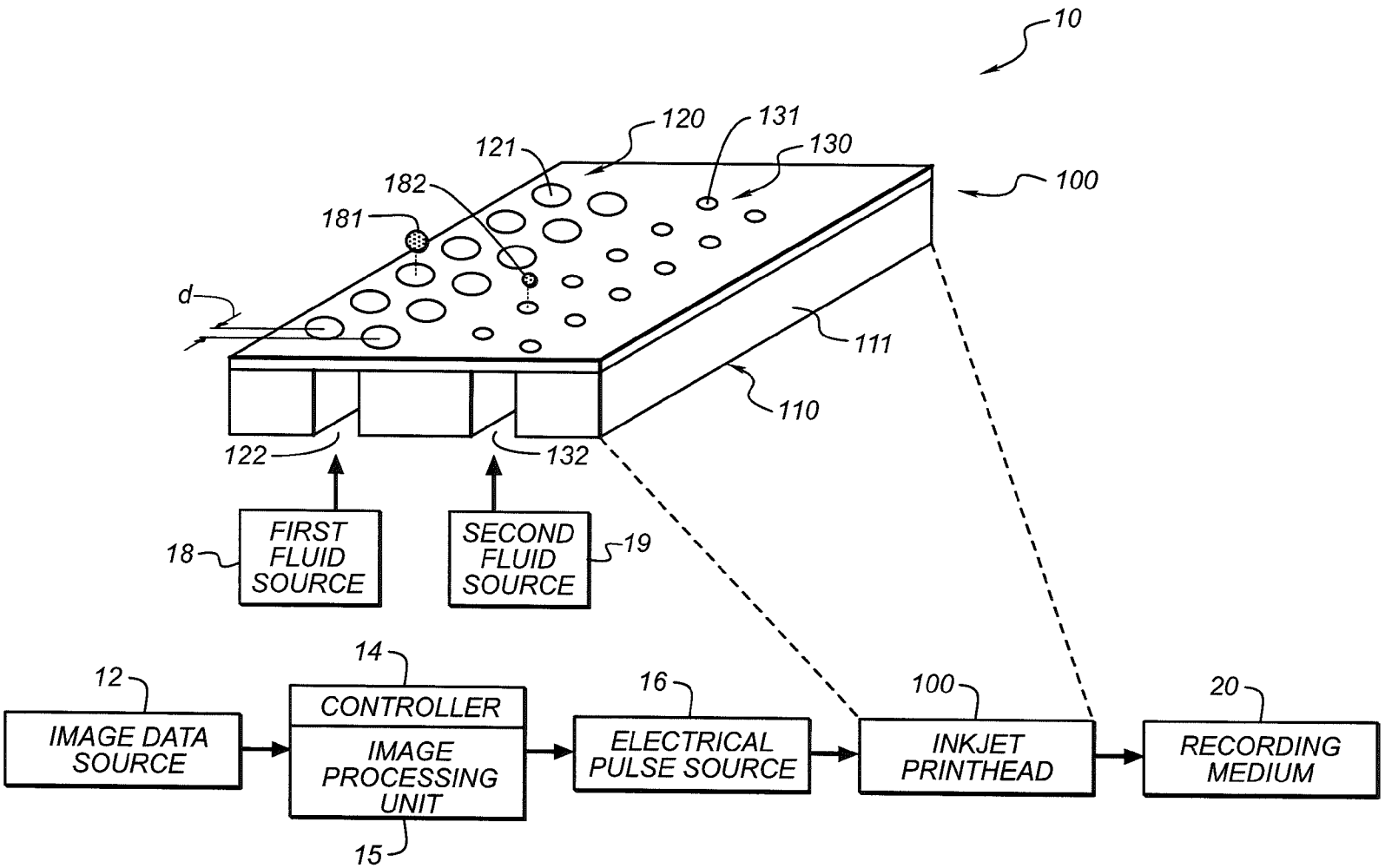
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms and pressurization chambers associated with the nozzles to form an array of drop ejectors corresponding to the nozzle array. Drop forming mechanisms can be of a variety of types, some of which include a resistive heater to vaporize a portion of ink and thereby cause ejection of a droplet, or an actuator which is made to move (for example, by resistively heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
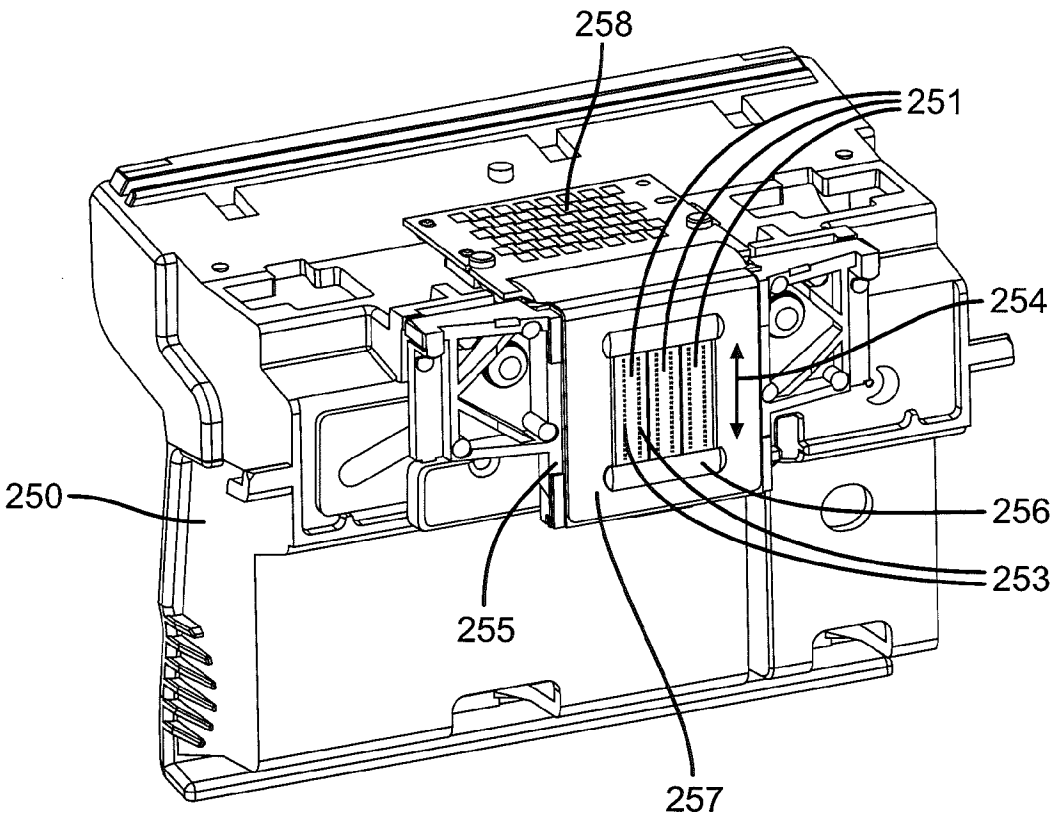
FIG. 2 is a perspective view of a portion of a printhead chassis.

FIG. 2 shows a perspective view of a portion of a printhead chassis 250, which is an example of an inkjet printhead 100 suitable for use in a carriage printer. Printhead chassis 250 includes three printhead die 251 (similar to printhead die 110 in FIG. 1), each printhead die 251 containing two nozzle arrays 253, so that printhead chassis 250 contains six nozzle arrays 253 altogether. The three printhead die 251 are affixed to a mounting substrate 255 for support and for fluidic connection to ink supplies. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals can be transmitted to the printhead die 251.

Figure 3:
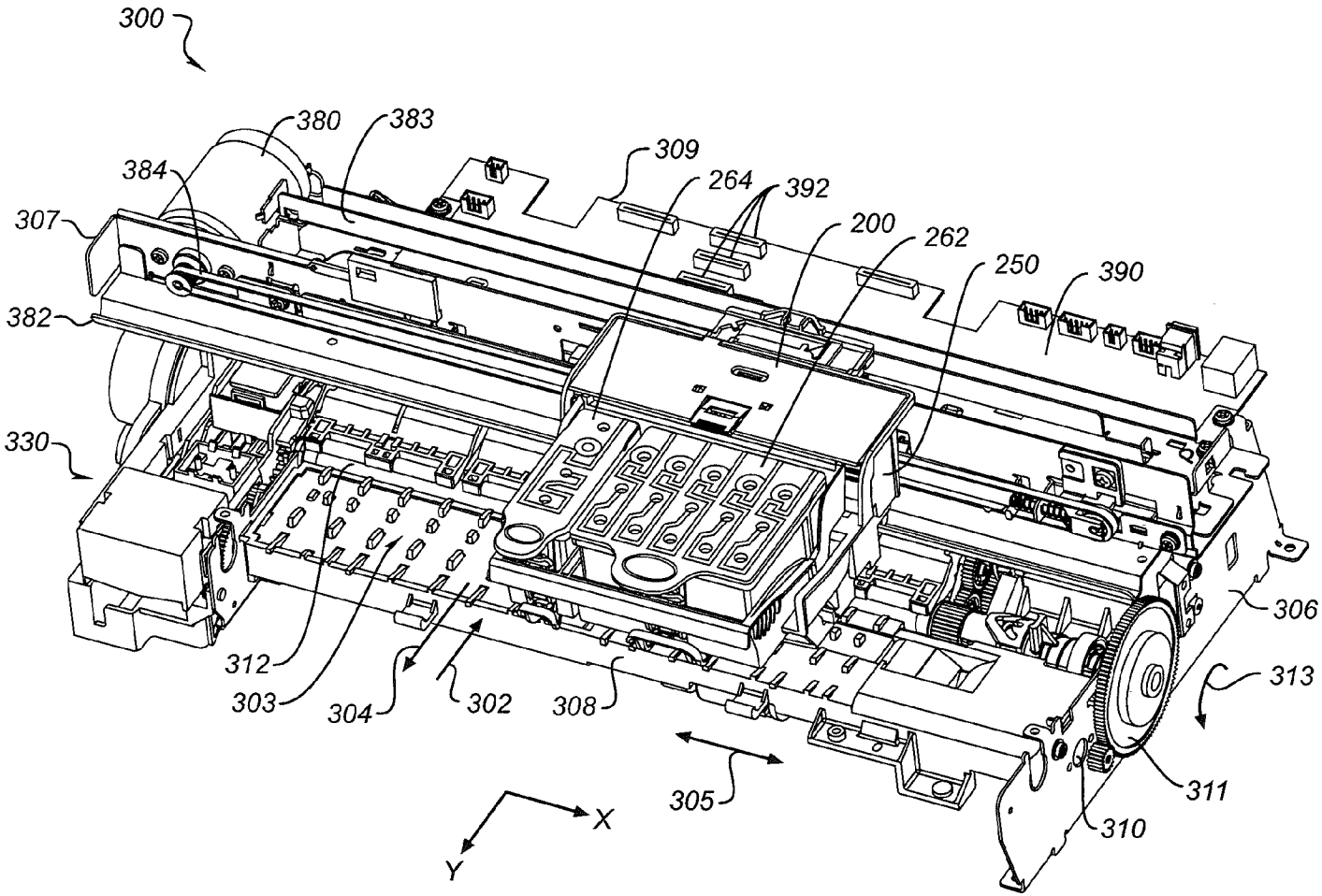
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink supply 262 and single-chamber ink supply 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view of FIG. 3. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printer chassis 308.

Figure 4:
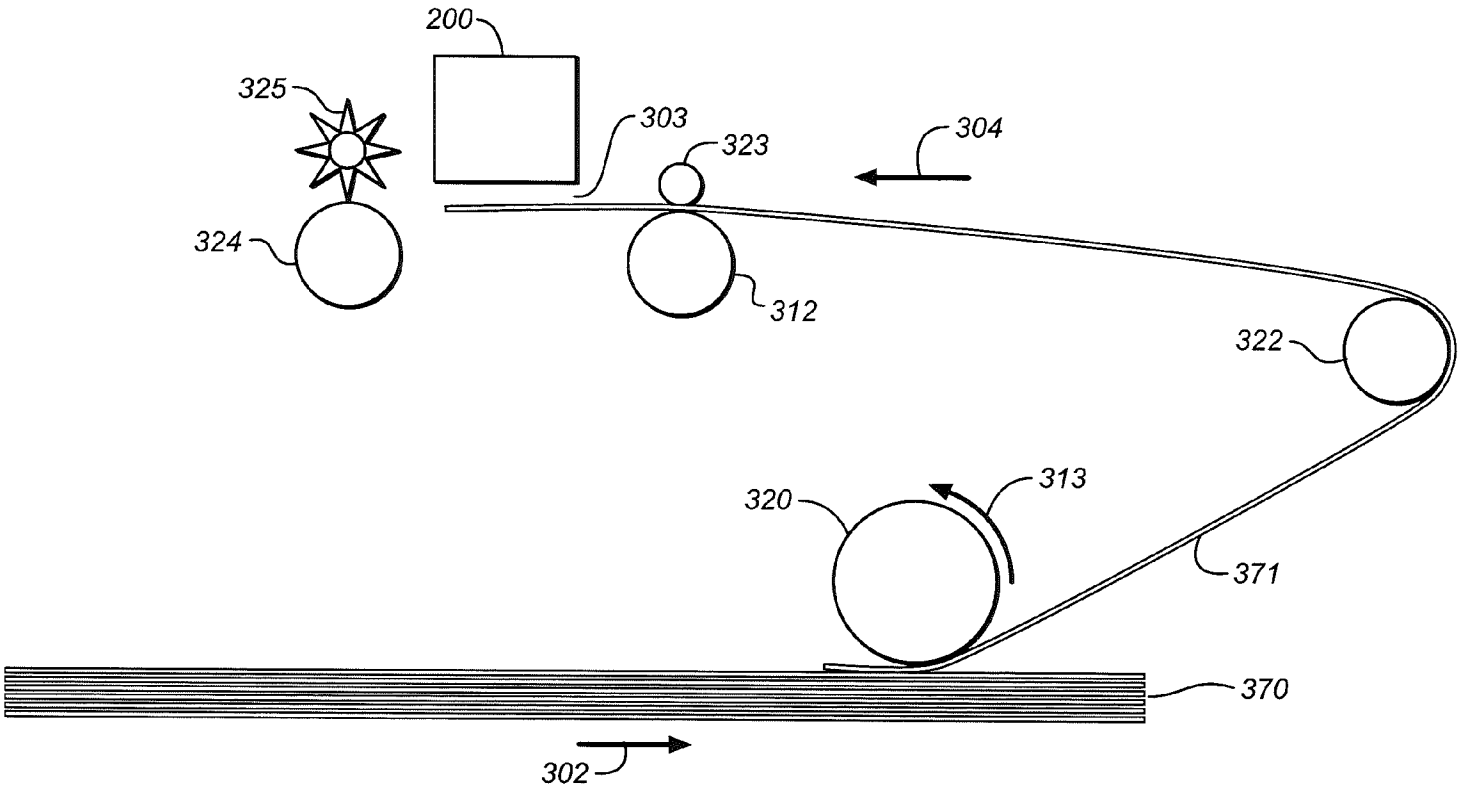
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
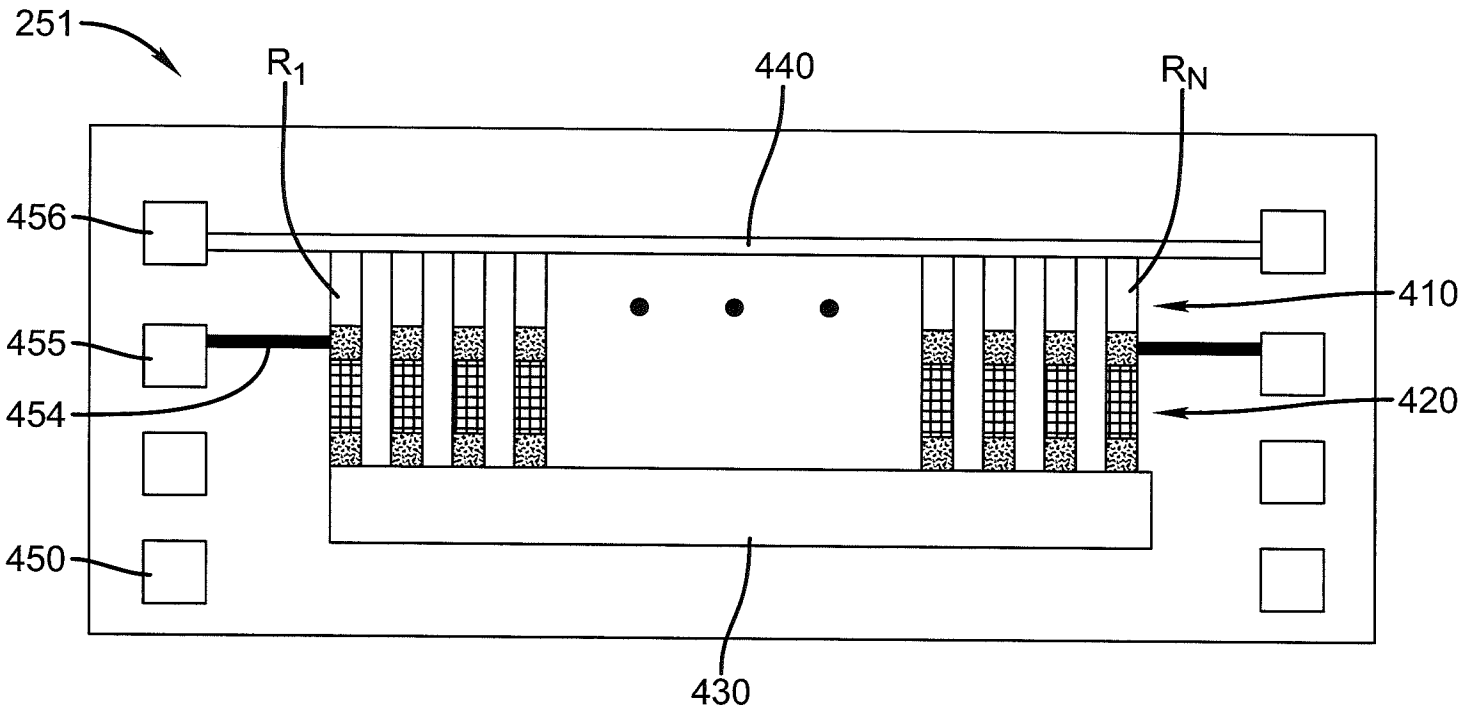
FIG. 5 PRIOR ART
FIG. 5 is a schematic representation of the electrical features on a prior art thermal inkjet printhead die.

FIG. 5 shows a schematic representation of a thermal inkjet printhead die 251 according to the prior art, showing resistive heater array 410, a corresponding transistor array 420, a logic section 430, and other electrical features, but not showing the fluidic features such as the corresponding nozzle array, the pressurization chambers, the ink inlet or other ink passageways. Resistive heater array 410 includes a total of N resistive heaters ($R_1$ to $R_N$), but only four at each end of the array are shown for simplicity. Transistor array 420 includes a driver transistor for each resistive heater for providing electrical pulses to the resistive heaters for vaporizing ink to eject drops of ink. A high voltage (typically on the order of 25 volts to 40 volts) is applied to common 440 at pads 456 and the transistors in transistor array 420 are controllably turned on or off to pulse the resistive heaters as needed to eject drops in the proper locations to form an image. Logic section 430 includes shift registers and other circuitry to control transistor array according to signals provided by controller 14 and electrical pulse source 16 (FIG. 1). Bond pads 450 and 456 are electrically connected to flex circuit 257 in printhead 250 as described above relative to FIG. 2 in order to provide high voltage to the common 440, as well as ground, logic power, data, clock and other electrical signals as needed to operate the printhead die 251. Pads 455 are test pads connected to end resistive heaters $R_1$ and $R_N$ in order to measure their resistance, as might be done according to methods described in U.S. Pat. No. 5,504,507 referred to in the background. It is not necessary that the test pads 455 be connected to the end resistive heaters $R_1$ and $R_N$, but it is typically preferred to test the end resistive heaters because it is easier to provide test leads 454 to the end resistive heaters without requiring crossovers, and the leads 454 can be very short so that they have low resistance. Leads 454 and pads 450, 455 and 456 are made of a thin metal film such as aluminum and have much lower resistance than the resistive heaters, which are made of a resistive material such as tantalum silicon nitride. By having low resistance leads 454 and pads 455 and 456, a nominal resistance can be assumed for the leads and pads. Any effect of manufacturing variability in the leads and pads will cause only a small variation compared to the resistance of the resistive heaters $R_1$ and $R_N$, which are typically several hundred ohms. Leads 454 connect between end resistive heaters $R_1$ and $R_N$ and their corresponding transistors, so that a measurement between probes contacting pads 455 and 456 allows measurement of the resistance. In this way, resistive heaters $R_1$ and $R_N$ can be characterized for each printhead die, in order to provide a correction for pulsing conditions as disclosed in U.S. Pat. No. 5,504,507.

Embodiments of the present invention provide improved test resistors that enable determination of the sheet resistance of the resistive heaters, as well as resistive heater length and optionally the resistive heater width for each printhead die. Such measurements provide improved accuracy in the correction relative to U.S. Pat. No. 5,504,507 because they allow correction for power density and energy density dissipated in the resistive heaters, rather than merely for power and energy.

Figure 6:
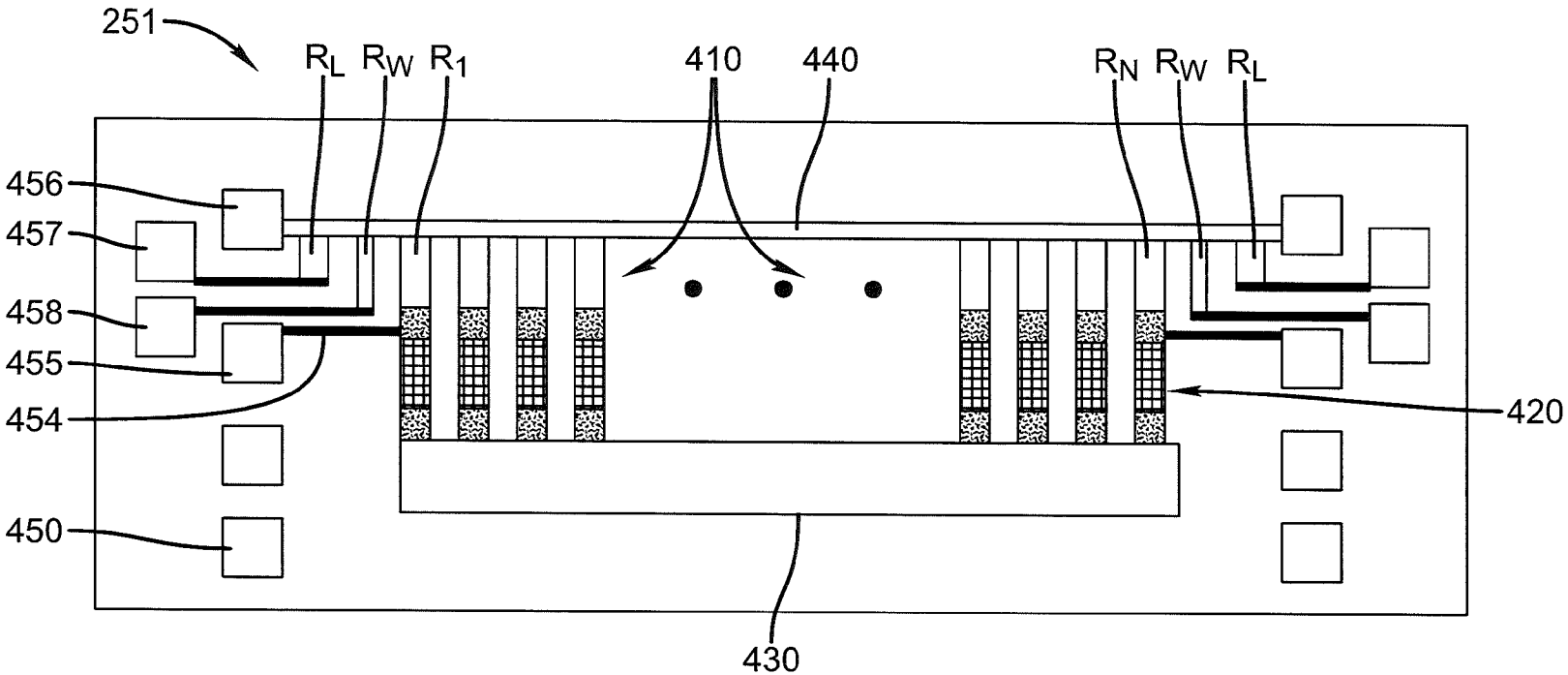
FIG. 6 is a schematic representation of the electrical features including test resistors on a thermal inkjet printhead die according to an embodiment of the invention.
Figure 7A:
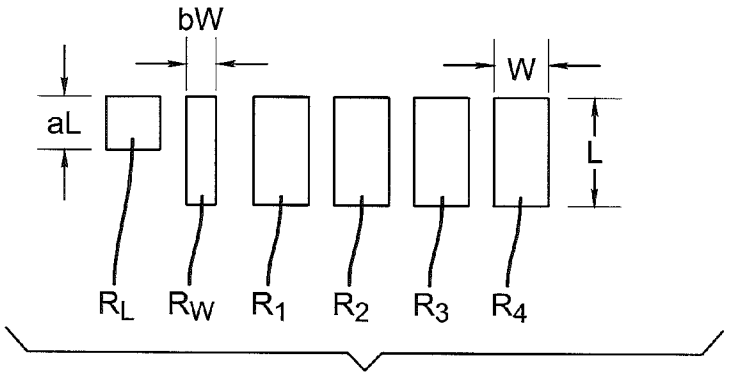
FIGS. 7A and 7B show different configurations of resistive heaters and corresponding test resistors.

FIG. 6 shows an embodiment in a thermal inkjet printhead die 251 that is similar to the prior art printhead die shown in FIG. 5, but with additional test resistors $R_L$ and $R_W$. In particular, FIG. 6 shows a schematic representation of a thermal inkjet printhead die 251 having a resistive heater array 410 that corresponds to a drop ejector array, a corresponding transistor array 420, a logic section 430, and other electrical features, but not showing the fluidic features such as the corresponding nozzle array, the pressurization chambers, the ink inlet or other ink passageways. A single straight line array 410 is shown in the example of FIG. 6, but there can be multiple resistive heater arrays and/or staggered arrays as disclosed above relative to FIGS. 1 and 2 with corresponding test resistors. FIG. 7A shows a close-up view of resistive heaters $R_1$ to $R_4$ as well as length test resistor $R_L$ and width test resistor $R_W$. All of the resistive heaters (including up through $R_N$) have a nominal length L and a nominal width W. Length test resistor $R_L$ has a nominal length equal to aL and a nominal width equal to cW. In the example shown in FIG. 7A, a=0.5 and c=1, so that the length test resistor is nominally half as long and the same width as resistive heater R. Width test resistor $R_W$ has a nominal width equal to bW and a nominal length equal to dL. In the example shown in FIG. 7A, b=0.5 and d=1, so that the width test resistor is nominally half as wide and the same length as resistive heater $R_1$.

Although the sheet resistance $\rho_s$ of the resistor material can vary significantly across a wafer or especially from wafer to wafer or batch to batch due to changes in thickness or chemical composition, such manufacturing variability is very small for resistors that are very close to each other. Since the resistive heater spacing in a resistive heater array 410 can be on the order of $1/600^{th}$ of an inch (about 42 microns) the distance from $R_1$ to $R_L$, and $R_W$ is typically less than about 100 microns, and similarly for $R_N$, $R_L$, and $R_W$ at the other end of the array. In addition, mask exposure, development, and etching conditions are sufficiently similar on such a localized scale that any differences from nominal widths or lengths between $R_1$ and its neighboring test resistors $R_L$, and $R_W$ can be assumed to be essentially identical.

A test pad 457 is connected to length test resistor $R_L$, and a test pad 458 is connected to width test resistor $R_W$. Leads connecting test pad 457 to length test resistor $R_L$, and connecting test pad 458 to width test resistor $R_W$ are shown but not labeled in FIG. 6. In any case, these leads, like lead 454 have a nominal resistance that is on the order of an ohm, so that any variations in lead resistance are small compared to the resistance of the resistive heater which is typically several hundred ohms. Resistance of the respective test resistors can be measured by probes contacting test pads 457, 458 and pad 456 that is connected to the common. Similarly, the resistance of $R_1$ can be measured by probes contacting test pad 455 (connected to $R_1$) and pad 456. In some embodiments, an additional test resistor is provided with nominal length and nominal width equal to those of $R_1$, so that it is not $R_1$ and $R_N$ themselves (the resistive heaters corresponding to a first drop ejector at or near the first end of the array and a second drop ejector at or near the second end of the array) that is measured, but a nearby test resistor. However, to save space, it can be preferred to measure $R_1$ and $R_N$ themselves, as in FIG. 6.

During manufacturing, a target sheet resistance is aimed at, such that all of the resistive heaters $R_1$ to $R_N$ as well as the test resistors $R_W$ and $R_L$, have the same nominal sheet resistance, but the actual sheet resistance can vary across a wafer, across a batch, and even across a die. Measurement of the test resistors can determine the actual length, the actual width and the actual sheet resistance for the resistive heaters ($R_1$ or $R_N$) that are in the vicinity of the measured test resistors.

Let $\delta_L$ be the error in length relative to the nominal length for the resistive heater $R_1$ (or $R_N$) and the corresponding nearby test resistors. Then the actual length of $R_1$ is $L_1=L+\delta_L$, and the actual length of nearby length test resistor $R_L$, is $L_L=aL+\delta_L$. As indicated above, the nominal width of the length test resistor is equal to cW, and the nominal width of $R_1$ is W. In this first example in order to simplify the calculations, assume c=1 (i.e. the nominal width of the length test resistor is the same as that of the nominal length for the nearby resistive heater). Because of their proximity to each other it can be assumed that the actual width of the length test resistor is equal to $W_1$, the actual width of $R_1$. Then $$R_1=\rho_{s1}L_1/W_1=\rho_{s1}(L+\delta_L)/W_1 \quad \text{(2) and}$$

$$R_L=\rho_{s1}L_1/W_1=\rho_{s1}(aL+\delta_L)/W_1 \quad (3)$$

where $\rho_{s1}$ is the sheet resistance in the immediate vicinity of $R_1$. Equations (2) and (3) can be solved for $\delta_L$ as shown in equation (4) below:

$$\delta_L=L(R_L-aR_1)/(R_1-R_L) \quad (4).$$

Thus the actual length of resistive heater $R_1$ is $L+\delta_L$, where $\delta_L$ is determined by parameters that are either measured ($R_L$ and $R_1$) or given as nominal (a and L).

Similarly, let $\delta_W$ be the error in width relative to the nominal width for the resistive heater $R_1$ (or $R_N$) and the corresponding nearby test resistors. Then the actual width of $R_1$ is $W_1=W+\delta_W$, and the actual width of nearby width test resistor $R_W$ is $W_W=bW+\delta_W$. As indicated above, the nominal length of the width test resistor is equal to dL, and the nominal length of $R_1$ is equal to L. In this example in order to simplify the calculations, assume d=1 (i.e. the nominal length of the width test resistor is the same as that of the nominal width for the nearby resistive heater). Because of their proximity to each other it can be assumed that the actual length of the width test resistor is equal to $L_1$, the actual length of $R_1$. Then $$R_1=\rho_{s1}L_1/W_1=\rho_{s1}L_1/(W+\delta_W) \quad \text{(5) and}$$

$$R_W=\rho_{s1}L_1/W_W=\rho_{s1}L_1/(bW+\delta_W) \quad (6)$$

where $\rho_{s1}$ is the sheet resistance in the immediate vicinity of $R_1$. Equations (5) and (6) can be solved for $\delta_W$ as shown in equation (7) below:

$$\delta_W=W(bR_W-R_1)/(R_1-R_W) \quad (7).$$

Thus the actual width of resistive heater $R_1$ is $W+\delta_W$, where $\delta_W$ is determined by parameters that are either measured ($R_L$ and $R_1$) or given as nominal (b and W).

Now that both the actual length $L_1$ and the actual width $W_1$ of $R_1$ have been determined, the sheet resistance in the vicinity of $R_1$ and the nearby test resistors can be calculated as $\rho_{s1}=R_1W_1/L_1$. In other words, the actual power density $V^2/\rho_s L^2$ (see equation 1) in the vicinity of $R_1$ and $R_N$ for each printhead can be determined. The energy density due to a pulse width $\tau$ is the power density times $\tau$, so that the energy density is $\tau V^2/\rho_s L^2$. Deviations from the nominal sheet resistance or the nominal length of the resistive heater can thus be corrected for by modifying the amplitude V or the pulsewidth $\tau$. The actual sheet resistance and the actual length of $R_1$ or $R_N$ or an average of the actual sheet resistances and actual lengths for each resistive heater array can be stored on the inkjet printhead (for example on printhead die 251) as an electronically readable code, and then read by the printer when the printhead is installed, so that controller 14 (FIG. 1) can adjust pulse amplitude (i.e. the voltage) or pulse width (i.e. the pulse duration) accordingly for the resistive heater array(s) in that particular printhead. For example, if the actual sheet resistance is determined to be less than the nominal sheet resistance then the pulse duration and/or the voltage would be decreased relative to a nominal pulse duration or voltage. Similarly, if the actual length of the resistive heater is determined to be less than the nominal length then the pulse duration and/or the voltage would be decreased relative to a nominal pulse duration or voltage.

It is not necessary that the nominal width of the length test resistor be the same as the nominal width of the nearby resistive heater. It is also not necessary that the nominal length of the width test resistor be the same as the nominal length of the nearby resistive heater. In other words there can be embodiments where c is not equal to 1 and/or d is not equal to 1, although the calculations become more complex. In particular, it can be shown that the more general expressions related to equations 4 and 7 above are given by:

$$\delta_L=L[(cW+\delta_W)R_L-a(W+\delta_W)R_1]/[(W+\delta_W)R_1-(cW+\delta_W)R_L];$$

$$\delta_W=W[(b(L+\delta_L)R_W-(dL+\delta_L)R_1]/[(dL+\delta_L)R_1-(L+\delta_L)R_W].$$

One can substitute the expression for $\delta_W$ into the expression for $\delta_L$, and then reduce the resulting expression algebraically to an expression for $\delta_L$ in terms of known parameters. Similarly one can solve $\delta_W$ in terms of known parameters.

Although power density and energy density depend on the actual sheet resistance and the actual length of the resistive heaters, and not on the actual width, for the best accuracy of correction it is helpful to include a width test resistor as described above so that the actual sheet resistance can be calculated. In some embodiments, the width of the resistive heaters does not vary much across the wafer. In such an embodiment, a width test resistor is not required on each printhead die. Rather, one or more width test resistors can be included on the wafer from which the die are later cut. Such an approach can allow the printhead die to be slightly shorter due to fewer test resistors, which can result in the printhead die being slightly less costly.

Figure 7B:
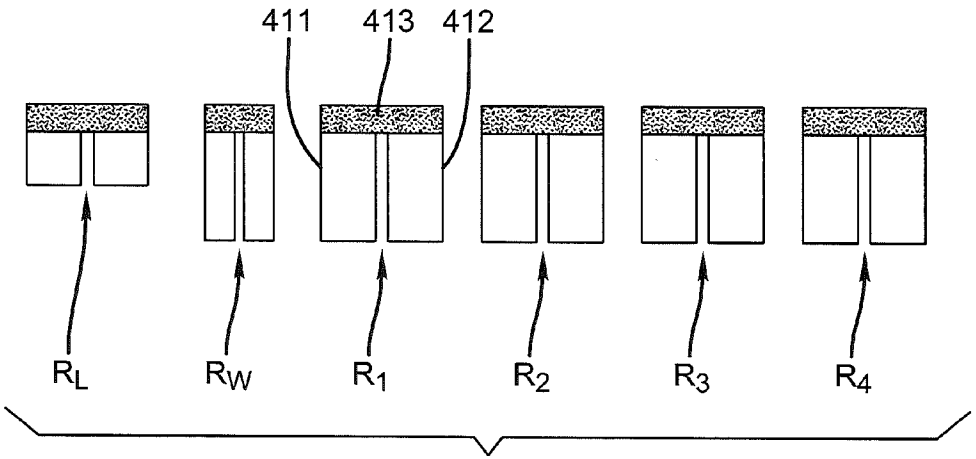

Although the resistive heaters and test resistors are shown in FIGS. 5, 6 and 7A as being simple rectangles, other configurations of resistive heaters are possible. FIG. 7B shows resistive heaters $R_1$ to $R_4$ and associated test resistors $R_L$, and $R_W$ that are configured as a first resistor leg 411, a second resistor leg 412 next to the first resistor leg 411, and a shorting bar 413 that joins two adjacent ends of the first resistor leg 411 and the second resistor leg 412. Shorting bar 413 is made of metal such as aluminum, while resistor legs 411 and 412 are made of a much more highly resistive material. A common for high voltage (similar to common 440 in FIG. 6) is connected to the end of first resistor leg 411 opposite the shorting bar 413 and the transistor (or the test pad similar to 457 or 458 for a test resistor) is connected to the end of second resistor leg 412 opposite the shorting bar 413. In such a configuration, the nominal length associated with the resistive heater $R_1$ or the test resistors $R_L$, and $R_W$ is the sum of the nominal lengths of first resistor leg 411 and second resistor leg 412. The nominal width associated with the resistive heater $R_1$ or the test resistors $R_L$ and $R_W$ is equal to the nominal width of one of the resistor legs 411 and 412, which are assumed to have the same nominal width as each other. The determination of actual length, actual width and actual sheet resistance for the configuration shown in FIG. 7B is done in a similar manner as described above for the configuration of FIG. 7A.

Figure 8:
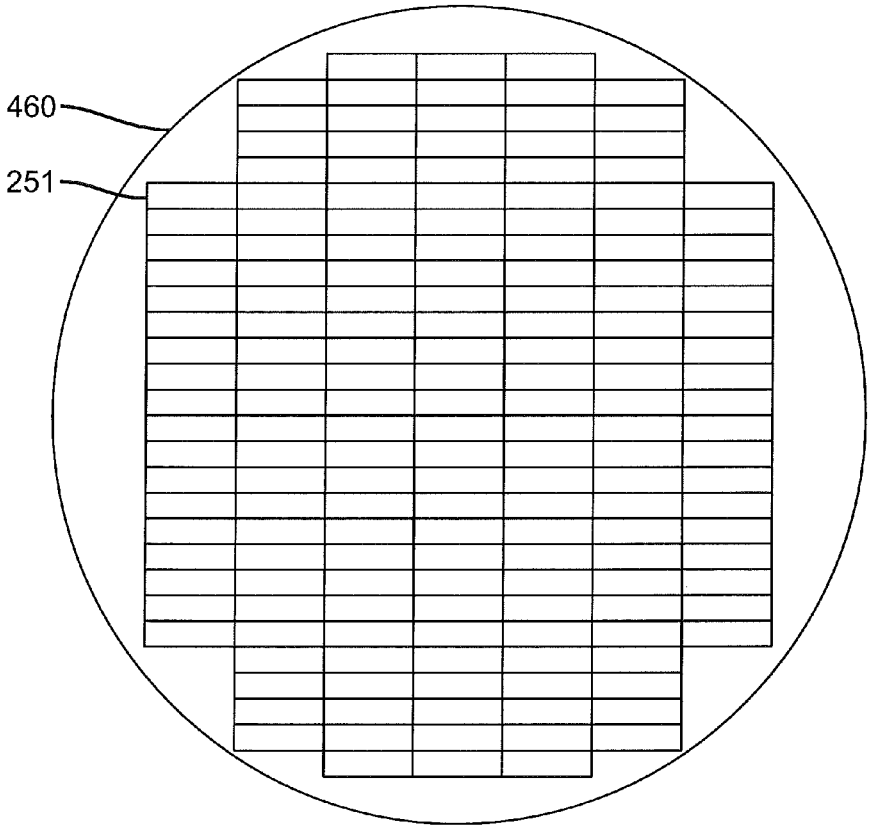
FIG. 8 shows a wafer including a plurality of printhead die.

FIG. 8 shows an example of a wafer 460 including a plurality of printhead die 251 arranged in a plurality of rows and columns including 3 central columns of 28 die each, plus 2 columns of 26 die each and 2 columns of 18 die each for a total of 172 die. The actual number of printhead die on a wafer depends upon the size of the die, the aspect ratio of the die and the size of a wafer. A typical wafer size is 8 inches in diameter. Typically the test resistor(s) on each printhead die 251 would be measured during electrical wafer probing which is done in order to identify defective die, as well as to characterize the die. The readable code could be provided during wafer probing, for example by blowing fuses in a pattern to represent a binary number related to the actual length and the actual sheet resistance (and optionally the actual width). Alternatively, the readable code could be provided after assembling the printhead die onto the mounting substrate.

As described above, a method of characterizing an array of resistive heaters having a first resistive heater (e.g. $R_1$) with a nominal sheet resistance, a first nominal length and a first nominal width includes a) providing a first configuration test resistor nearby the first resistive heater, the first configuration test resistor including a width that is equal to the first nominal width and a second nominal length that is different from the first nominal length; b) measuring a resistance of the first resistive heater; c) measuring a resistance of the first configuration test resistor; and d) determining the actual sheet resistance and the actual length of the first resistive heater based on the measured resistance of the first resistive heater and the first configuration test resistor. Optionally, the method also includes e) providing a second configuration test resistor nearby the first resistive heater, the second configuration test resistor including a length that is equal to the first nominal length, and a third nominal width that is different from the first nominal width; f) measuring a resistance of the second configuration test resistor; and g) determining the actual width of the first resistive heater based on the measured resistances of the first resistive heater and the second configuration test resistor. For embodiments where the second configuration test resistor is included, the determined actual sheet resistance (step d) is also based on the measured resistance of the second configuration test resistor. For embodiments where there is a first configuration test resistor and optionally a second configuration test resistor near a second resistive heater (e.g. $R_N$), the measurements would be made as described above for those test resistors as well.

The method described above is performed for each of the plurality of die on a wafer in order to provide the actual sheet resistance, the actual length and optionally the actual width of the first resistive heater for each of the plurality of die.

If $R_1$ is located on the left side and $R_N$ is located on the right side of the printhead die 251 in wafer 460 of FIG. 8, then $R_N$ for a first die in a first column is typically located closer to $R_1$ of a second die located in the same row but one column to the right. During wafer probing it can be useful to compare the actual sheet resistance and the actual length determined for $R_N$ of the first die to $R_1$ of the second die. In that way, in case there is a defect in one of the test resistors that would cause a spurious result, it can be checked relative to a nearby set of test resistors on an adjacent die. This comparison can be done for all test resistors on the wafer 460 except for the test resistors on the left side of the leftmost column of die and for the test resistors on the right side of the rightmost column of die.

Manufacturing of the electrical features (including the resistive heaters and the test resistors) can be done using standard wafer fabrication processes that are well known in the art. Such fabrication processes can include thin film deposition of resistive materials or metals by sputtering (nonreactive or reactive), and patterning of the thin films by patterning a photoresist by exposure through a mask and subsequent removal of thin film material by plasma etching or wet chemical etching.

The actual sheet resistances, actual lengths, and optionally the actual widths of the resistive heaters can be provided to the wafer manufacturer on a die by die location basis for each wafer. This data can be used to modify fabrication processes as needed. For example, if it is found that the actual widths are always too small, the resistor mask could be biased to increase the width. If the actual lengths are always too small, the aluminum etching process or the metal mask can be adjusted. If the actual sheet resistance is off target, the reactive sputtering process or its duration can be modified. If there is systematic variation by printhead die location across all wafers, the processes can be modified to make the variation smaller. In any case, providing the data to the wafer manufacturer can result in improved uniformity of actual lengths, actual widths and actual sheet resistances.

The invention has been described in detail with particular reference to certain preferred embodiments thereof, but it will be understood that variations and modifications can be effected within the spirit and scope of the invention. In particular, although embodiments were described relative to a printhead suitable for a carriage printer, the test resistors and method of characterizing resistor arrays can also be advantageously used for the multiple printhead die in a pagewidth printhead.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
250 Printhead chassis
251 Printhead die
253 Nozzle array
254 Nozzle array direction
255 Mounting substrate
256 Encapsulant
257 Flex circuit
258 Connector board
262 Multi-chamber ink supply
264 Single-chamber ink supply
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide rail
383 Encoder fence
384 Belt
390 Printer electronics board
392 Cable connectors
410 Resistive heater array
411 First resistor leg
412 Second resistor leg
413 Shorting bar
420 Transistor array
430 Logic section
440 Common
450 Bond pads
454 Test leads
455 Test pads (for end resistive heaters)
456 Bond/test pads (for common)
457 Test pads (for length test resistors)
458 Test pads (for width test resistors)
460 Wafer

The invention claimed is:

1. A method of characterizing an array of resistive heaters, a first resistive heater of the array having a nominal sheet resistance, a first nominal length and a first nominal width, the method comprising:

a) providing a first configuration test resistor disposed proximate the first resistive heater, the first configuration test resistor including a second nominal length and a second nominal width, wherein the second nominal length is different from the first nominal length;

b) measuring a resistance of the first resistive heater;

c) measuring a resistance of the first configuration test resistor; and d) determining the actual sheet resistance and the actual length of the first resistive heater based on the measured resistances of the first resistive heater and the first configuration test resistor.

2. The method according to claim 1, the array of resistive heaters being a first array being disposed on a first of a plurality of die on a wafer; the method further comprising performing steps a) through d) for each of the plurality of die on the wafer to provide the actual sheet resistance and the actual length of the first resistive heater for each of the plurality of die.

3. The method according to claim 2 further comprising modifying a wafer fabrication process based on the actual sheet resistance or the actual length of the first resistive heater for each of the plurality of die.

4. The method according to claim 1 further comprising:

e) providing a second configuration test resistor disposed proximate the first resistive heater, the second configuration test resistor including a third nominal length and a third nominal width, wherein the third nominal width is different from the first nominal width;

f) measuring a resistance of the second configuration test resistor; and g) determining the actual width of the first resistive heater based on the measured resistances of the first resistive heater and the second configuration test resistor.

5. The method according to claim 4, the array of resistive heaters being a first array being disposed on a first of a plurality of die on a wafer; the method further comprising performing steps a) through g) for each of the plurality of die on the wafer to provide the actual sheet resistance, the actual length and the actual width of the first resistive heater for each of the plurality of die.

6. The method according to claim 2 further comprising modifying a wafer fabrication process based on the actual sheet resistance or the actual length of the first resistive heater or the actual width of the first resistive heater for each of the plurality of die.

7. The method according to claim 1, the array further including a second resistive heater having the nominal sheet resistance, the first nominal length and the first nominal width, the method comprising:

h) providing a first configuration test resistor disposed proximate the second resistive heater, the first configuration test resistor including the second nominal length and the second nominal width i) measuring a resistance of the second resistive heater;

j) measuring a resistance of the first configuration test resistor disposed proximate the second resistive heater; and k) determining the actual sheet resistance and the actual length of the second resistive heater based on the measured resistances of the second resistive heater and the first configuration test resistor disposed proximate the second resistive heater.

8. The method according to claim 7, the array of resistive heaters being a first array being disposed on a first of a plurality of die on a wafer; the method further comprising performing steps a) through d) and h) through k) for each of the plurality of die on the wafer to provide the actual sheet resistance and the actual length of the first resistive heater and the second resistive heater for each of the plurality of die.

9. The method according to claim 8, the first resistive heater of each array being disposed proximate a first end of the array, and the second resistive heater of each array being disposed proximate a second end of the array.

10. The method according to claim 9, the plurality of die being arranged in a plurality of rows and columns on the wafer, the second resistive heater on a first die in a first column being disposed at a first distance from the first resistive heater on the first die, and the second resistive heater on the first die being disposed at a second distance from a first resistive heater on a second die in a second column, wherein the second distance is less than the first distance.

11. The method according to claim 10 further comprising comparing the actual sheet resistance determined for the second resistive heater on the first die to the actual sheet resistance determined for the first resistive heater on the second die.

12. The method according to claim 10 further comprising comparing the actual length determined for the second resistive heater on the first die to the actual length determined for the first resistive heater on the second die.

13. A method of controlling pulsing of an array of resistive heaters in a thermal inkjet printer, the array including a first resistive heater having a nominal sheet resistance, a first nominal length and a first nominal width, the method comprising:

a) providing a first configuration test resistor disposed proximate the first resistive heater, the first configuration test resistor including a second nominal length and a second nominal width, wherein the second nominal length is different from the first nominal length;

b) measuring a resistance of the first resistive heater;

c) measuring a resistance of the first configuration test resistor; and d) determining the actual sheet resistance and the actual length of the first resistive heater based on the measured resistances of the first resistive heater and the first configuration test resistor;

e) providing a readable code related to the actual sheet resistance and the actual length of the first resistive heater; and f) controlling the pulsing of the array of resistive heaters based on the readable code.

14. The method according to claim 13, wherein controlling the pulsing of the array of resistive heaters further comprises adjusting a duration of a pulse.

15. The method according to claim 14, wherein adjusting a duration of a pulse further comprises decreasing the duration from a nominal duration if the actual sheet resistance is determined to be less than the nominal sheet resistance.

16. The method according to claim 14, wherein adjusting a duration of a pulse further comprises decreasing the duration from a nominal duration if the actual length of the first heater is determined to be less than the nominal length of the first heater.

17. The method according to claim 13, wherein controlling the pulsing of the array of resistive heaters further comprises adjusting a voltage of a pulse.

18. The method according to claim 17, wherein adjusting a voltage of a pulse further comprises decreasing the voltage from a nominal voltage if the actual sheet resistance is determined to be less than the nominal sheet resistance.

19. The method according to claim 17, wherein adjusting a voltage of a pulse further comprises decreasing the voltage from a nominal voltage if the actual length of the first heater is determined to be less than the nominal length of the first heater.

* * * * *